US007533635B2

(12) United States Patent
Bradley et al.

(10) Patent No.: US 7,533,635 B2
(45) Date of Patent: May 19, 2009

(54) METHOD AND DEVICE FOR A PROACTIVE COOLING SYSTEM FOR A MOTOR VEHICLE

(75) Inventors: James C. Bradley, New Haven, IN (US); Scott A. Wooldridge, Fort Wayne, IN (US); Rodney J. Klinger, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 449 days.

(21) Appl. No.: 11/369,783

(22) Filed: Mar. 7, 2006

(65) Prior Publication Data

US 2007/0209610 A1 Sep. 13, 2007

(51) Int. Cl.
*F01P 3/00* (2006.01)
*F01P 7/00* (2006.01)

(52) U.S. Cl. ..... 123/41.29; 123/41.51

(58) Field of Classification Search ..... 123/41.01, 123/41.09, 41.1, 41.29, 41.31, 41.44, 41.45, 123/41.49, 41.51
See application file for complete search history.

(56) References Cited

U.S. PATENT DOCUMENTS 5,553,661 A 9/1996 Beyerlein et al.
6,343,572 B1 * 2/2002 Pfaff et al. ..... 123/41.01
6,408,232 B1 6/2002 Cannon et al.
6,530,347 B2 * 3/2003 Takahashi et al. ..... 123/41.1
6,616,059 B2 * 9/2003 Sabhapathy et al. ..... 237/12.3 B
6,642,838 B1 11/2003 Barnas et al.
6,786,183 B2 * 9/2004 Hoelle et al. ..... 123/41.44
7,000,685 B2 * 2/2006 Morishita et al. ..... 165/80.4
7,128,025 B1 * 10/2006 Westhoff et al. ..... 123/41.01
7,182,049 B2 * 2/2007 Wikstrom ..... 123/41.31
7,210,522 B2 * 5/2007 Gruian ..... 165/202
7,261,068 B1 * 8/2007 Wantschik ..... 123/41.29
7,267,084 B2 * 9/2007 Lutze et al. ..... 123/41.02
7,334,544 B2 * 2/2008 Eberspach ..... 123/41.1
2004/0187805 A1 * 9/2004 Arisawa et al. ..... 123/41.14
2006/0185626 A1 * 8/2006 Allen et al. ..... 123/41.12

* cited by examiner

*Primary Examiner*—Hai H Huynh
(74) *Attorney, Agent, or Firm*—Mark C. Bach; Jeffrey P. Calfa

(57) ABSTRACT

A proactive cooling system and method improve the cooling of a motor vehicle apparatus, such as an engine or transmission, in a motor vehicle. The proactive cooling system boosts the primary cooling system connected to the motor vehicle apparatus by using an electronic controller, an information collecting module for collecting information related to the operation of the motor vehicle and an auxiliary cooling system. The auxiliary cooling system uses a power supply and a secondary cooling system in fluid communication with the primary cooling system. The power supply turns on the secondary cooling system by activating an activator and a secondary pump. The activator opens a bypass circuit to divert coolant from the primary cooling system into the secondary cooling system where the diverted coolant is cooled in a secondary heat exchanger. A secondary pump circulates the coolant through the bypass circuit and back to the primary cooling system.

36 Claims, 9 Drawing Sheets

METHOD AND DEVICE FOR A PROACTIVE COOLING SYSTEM FOR A MOTOR VEHICLE

BACKGROUND OF THE INVENTION

1. Field of the Invention

The present invention relates to cooling systems for motor vehicles powered by engines, such as trucks that are powered by internal combustion engines.

2. Description of the Prior Art

The internal combustion engine of a motor vehicle generates large quantities of heat during use. Air-cooled or liquid-cooled cooling systems remove the generated heat from the engine and other components of a motor vehicle. Air-cooling, where heat transfer occurs directly from the engine to ambient air, may be adequate for some small engines. Motor vehicles powered by large engines, however, typically require a liquid cooling system.

One such liquid cooling system uses a radiator in a coolant circuit with the engine for cooling a coolant or cooling water, and a water pump or a flow control valve to control the flow rate of the coolant that passes through the radiator. A flow control valve typically opens in response to a control signal from an electronic controller module (ECM) to circulate cooling water from the radiator with the water pump through tubing into coolant passages in the block and heads of the engine. The cooling water receives heat from the engine, then returns to the radiator. The tubing within the coolant passages can include a bypass flow passage and a heater flow passage. The bypass flow passage allows the warmed cooling water to again circulate into the coolant passages of the engine to reduce variations in water temperature and water pressure. The heater flow passage circulates the warmed cooling water between the coolant passages and a heater for warming the interior space in the cold.

In such a cooling water control system, a sensor detects the temperature of cooling water within the engine. Depending on the detected temperature, the cooling water control valve opens to control the circulation flow rate of cooling water to the radiator. This controls the temperature of the cooling water within the engine to a predetermined temperature in relation to the driving conditions, such as the engine load or engine speed, and improves the fuel efficiency, exhaust performance and drive performance of the motor vehicle. This system attempts to improve the engine power and to secure the reliability during high engine loads and may reduce friction and improve combustion during low engine load.

When the engine is required to generate a high level of driving power, the coolant temperature is lowered to increase the cooling efficiency. When the engine is required to operate with low fuel consumption, such as at a high fuel efficiency, the coolant temperature rises to increase the combustion efficiency. In this manner, the coolant temperature is controlled to achieve sufficiently high levels in opposite performances or characteristics, such as high power or output performance and low fuel consumption.

Like the engine, the transmission also heats during use. The transmission typically has a separate circuit from the transmission to the radiator for cooling the transmission fluid or oil.

Motor vehicles are used in a variety of extreme conditions. Whether driving in the blistering Arizona summer, the frigid North Dakota winter, charging up a mountain or gliding in Florida, the motor vehicle's cooling system must respond to all conditions. The cooling systems therefore are sized to meet extreme conditions, rather than normal operating conditions.

The prior art cooling systems require the entire cooling system to react to a change in conditions as it happens. Because of their size, there is a lag in cooling as these systems slowly react to these changes.

In these cooling systems control of the coolant flow, such as by the opening of the flow control valve, is based only upon a difference between the actual coolant temperature and the target coolant temperature. The cooling system thus suffers from poor response when controlling the coolant temperature to the target coolant temperature. In particular, when a quantity of heat equivalent to a cooling loss of the engine changes with a change in the operating state of the engine, coolant temperature control is poor. Here, the coolant loss is a quantity of heat removed from the engine and radiated or absorbed into the coolant in the process in which the coolant passes through the engine. If the coolant loss changes as described above, a power loss occurs which is detrimental to improvements in the fuel efficiency and the output performance. A similar problem may be encountered in a cooling system in which the flow rate of coolant passing through a radiator is controlled by an water pump, in place of the flow control valve.

Therefore, it would be advantageous to provide a cooling system that uses a smaller sized or primary system to handle cooling for most of the average road conditions, but uses an auxiliary cooling device to augment the primary system for extreme conditions. These systems could be activated manually by the driver or through the use of an electronic controller. It would also be a further advantage to provide a proactive auxiliary cooling device that could turn on and start cooling the motor vehicle before reaching extreme conditions. It would still be another advantage to have an auxiliary cooling device that could be installed optionally during assembly in a motor vehicle with modules that would react only to conditions likely to be met.

SUMMARY OF THE INVENTION

According to the invention, there is provided a proactive cooling system to improve the cooling of a motor vehicle apparatus, such as an engine or transmission, in a motor vehicle and a method therefor. The proactive cooling system includes a primary cooling system connected to the motor vehicle apparatus, an electronic controller, an information collecting module cooperating with the electronic controller and an auxiliary cooling system.

The auxiliary cooling system uses a power supply and a secondary cooling system in fluid communication with the primary cooling system. The power supply turns on the secondary cooling system by activating an activator and a secondary pump. The activator opens a bypass circuit to divert coolant from the primary cooling system into the secondary cooling system.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
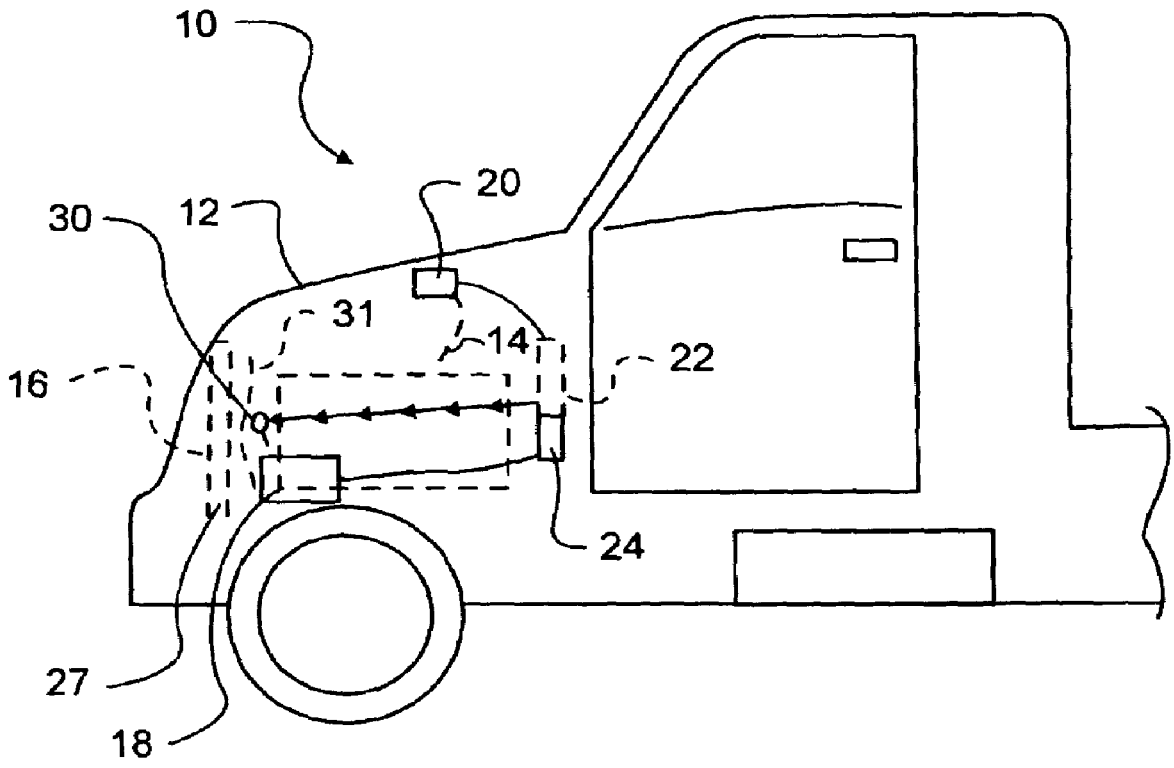
FIG. 1 is a partial view of a motor vehicle with the auxiliary cooling system of the invention.
Figure 2:
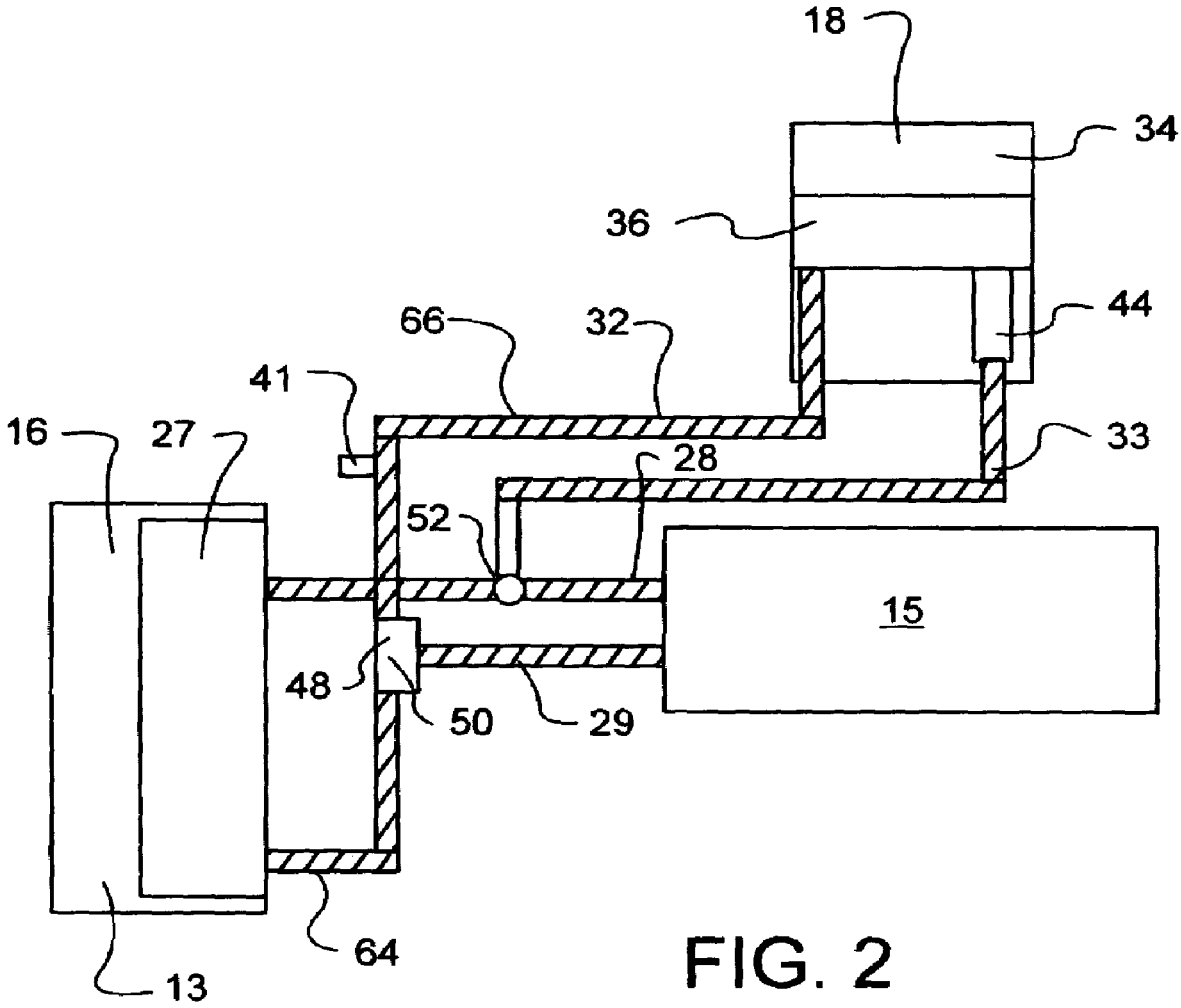
FIG. 2 is a block diagram of one embodiment of the invention showing the primary and secondary cooling systems.
Figure 3:
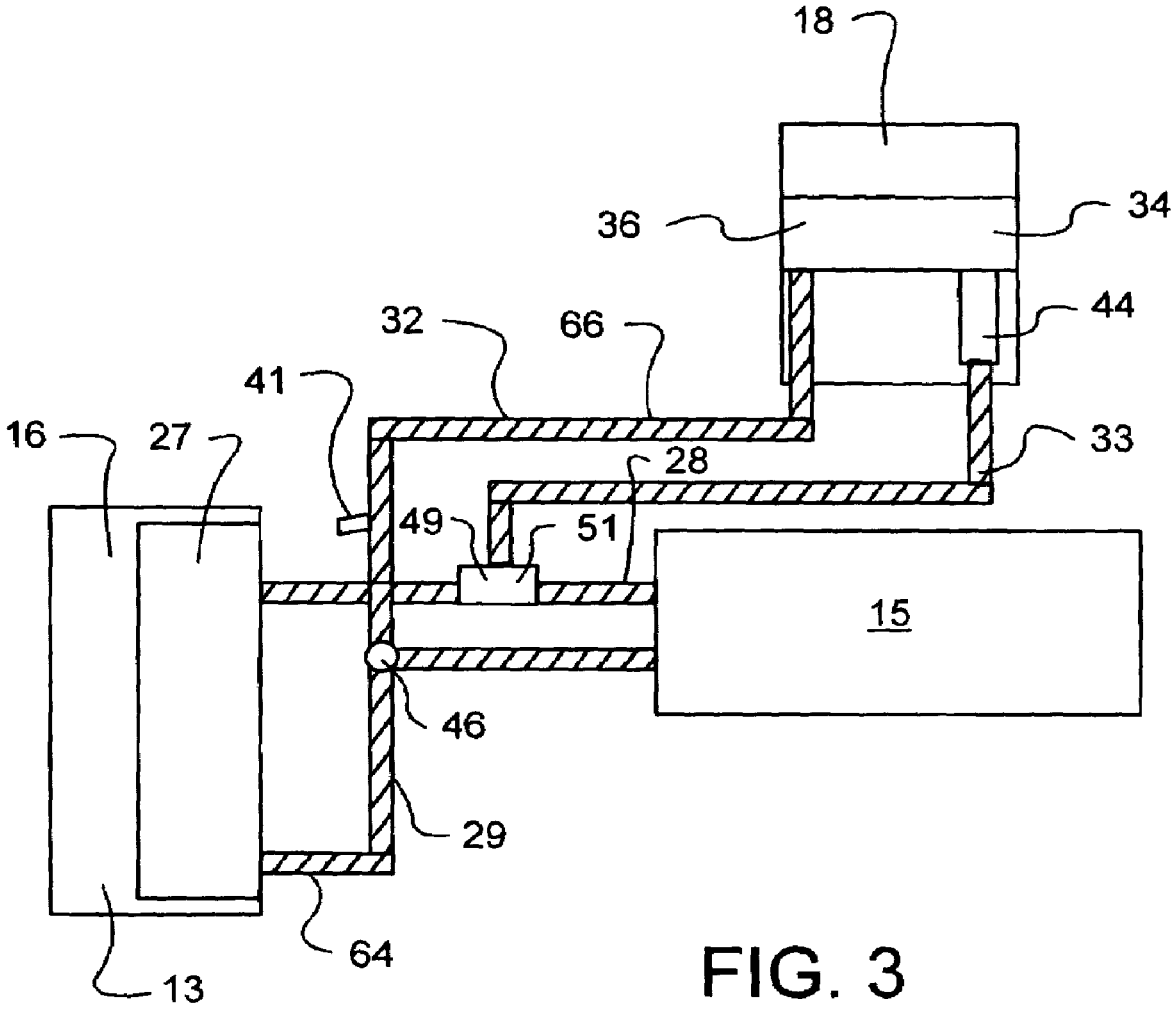
FIG. 3 is a block diagram of one embodiment of the invention showing the primary and secondary cooling systems.
Figure 4:
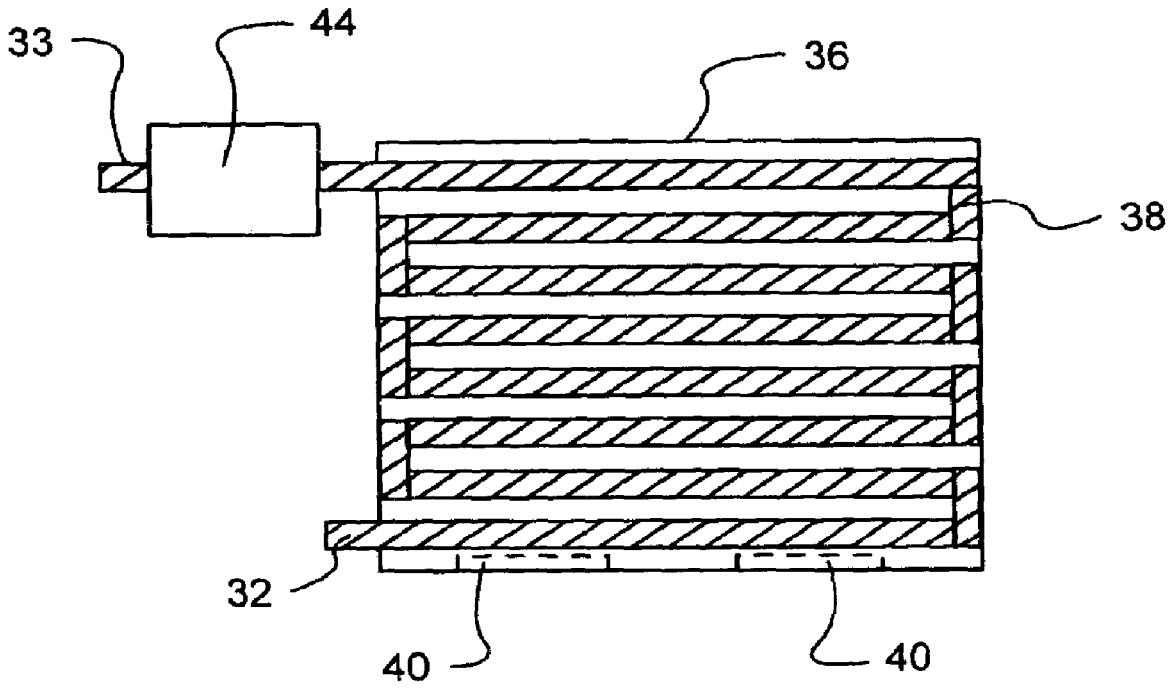
FIG. 4 is a top plan view with the top cut away showing part of the secondary cooling system of the invention with the heat exchanger and the pump.
Figure 5:
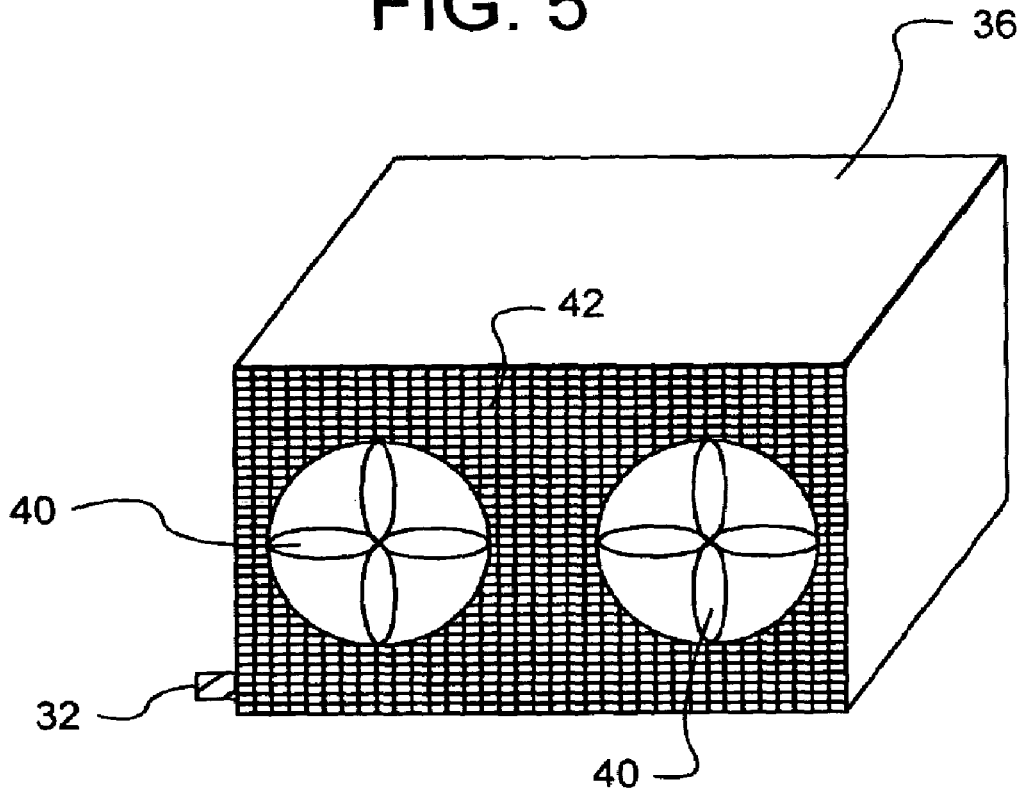
FIG. 5 is a perspective view showing the heat exchanger.
Figure 6:
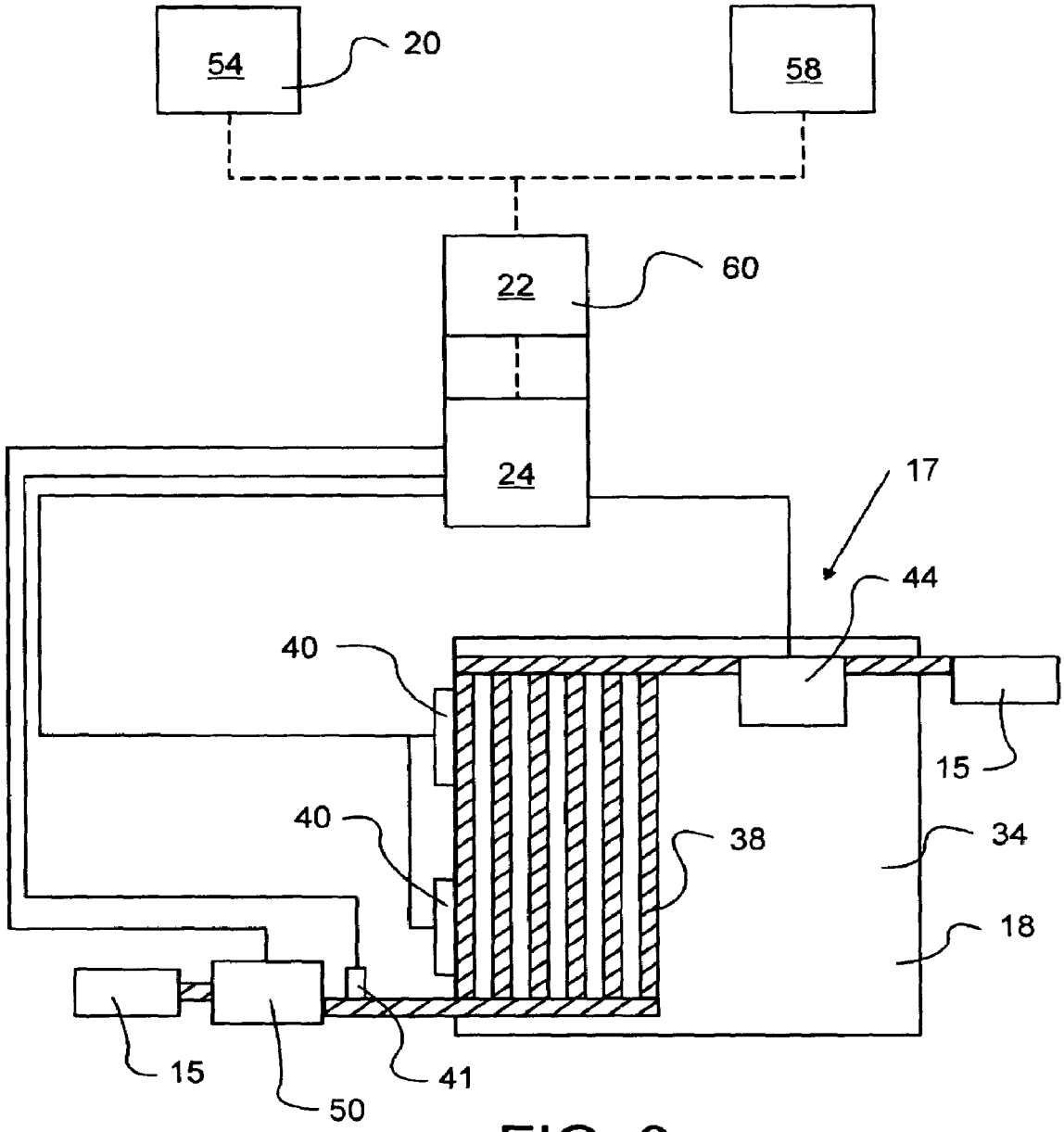
FIG. 6 is a block diagram of one embodiment of the invention with the primary cooling system removed.
Figure 7:
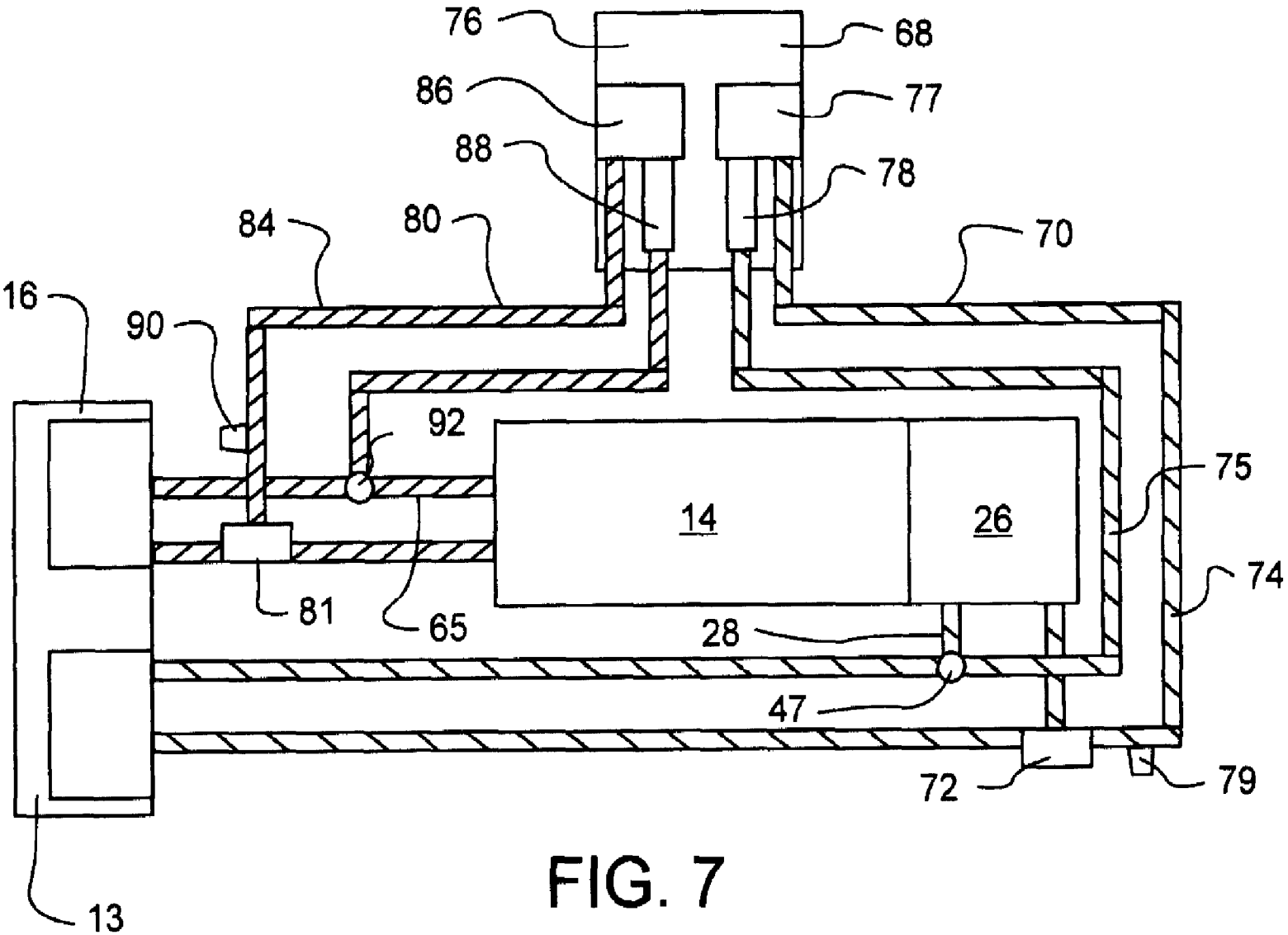
FIG. 7 is a block diagram of one embodiment of the invention showing the primary and secondary cooling systems.
Figure 8:
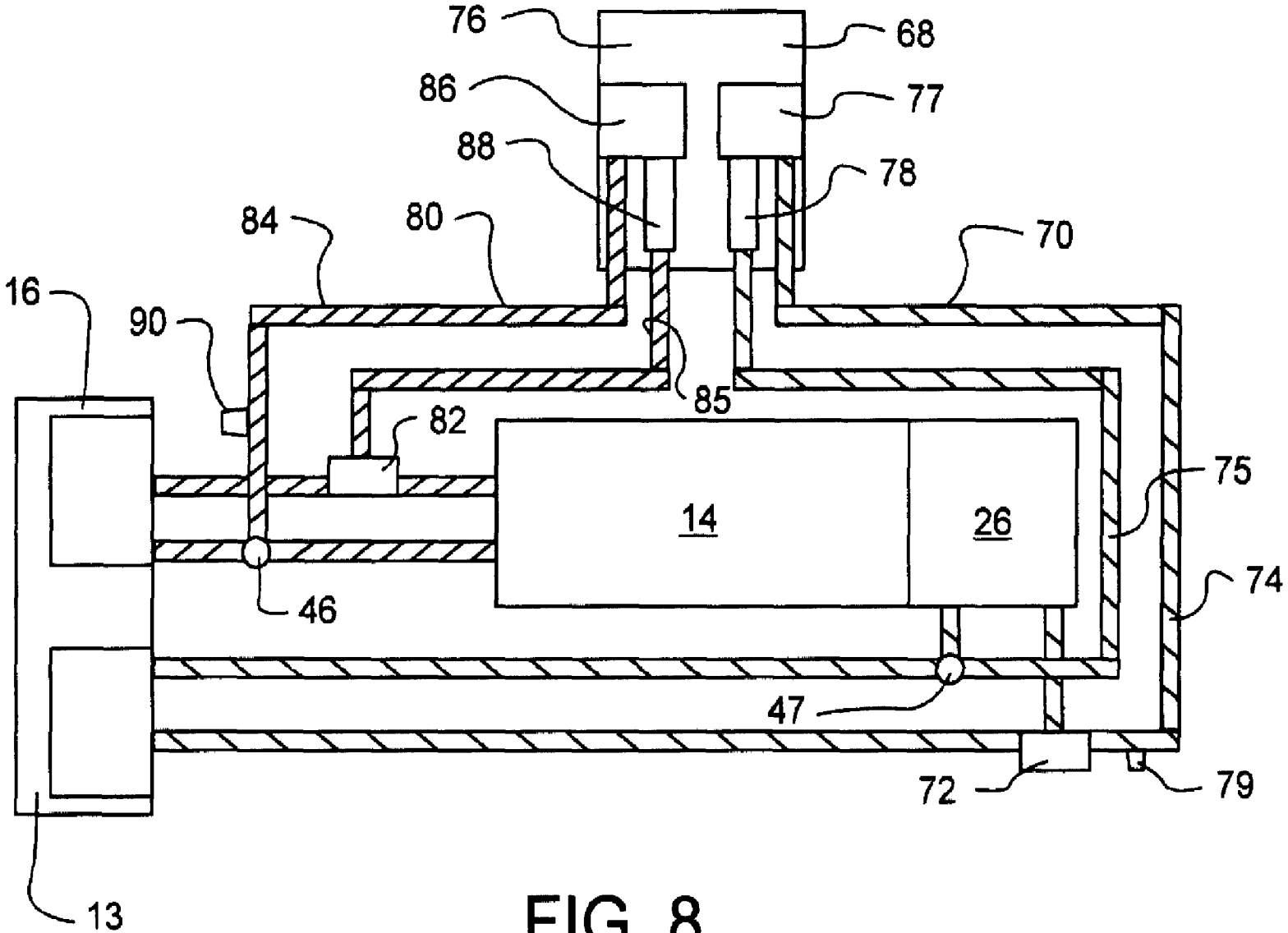
FIG. 8 is a block diagram of one embodiment of the invention showing the primary and secondary cooling systems.
Figure 9:
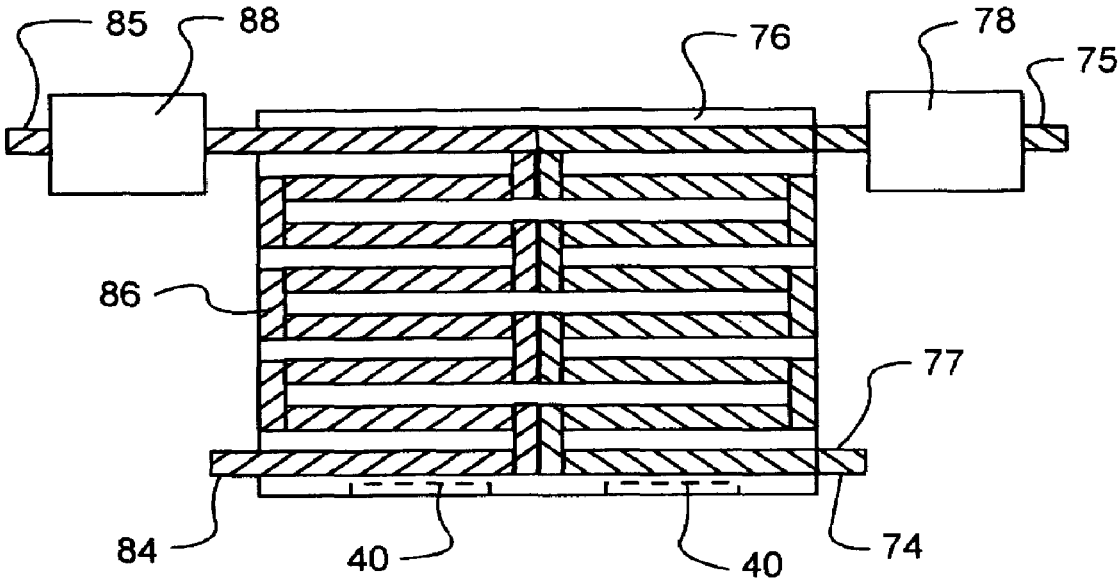
FIG. 9 is a top plan view with the top cut away showing part of the secondary cooling system of the invention with the heat exchanger and the pump.
Figure 10:
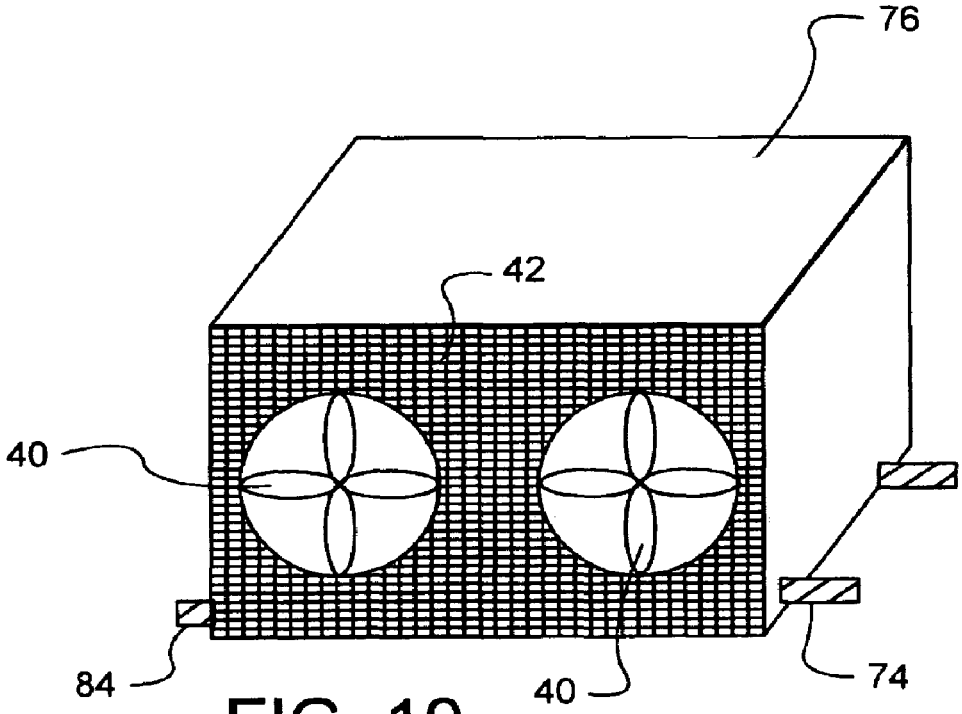
FIG. 10 is a perspective view showing part of the heat exchanger.
Figure 11:
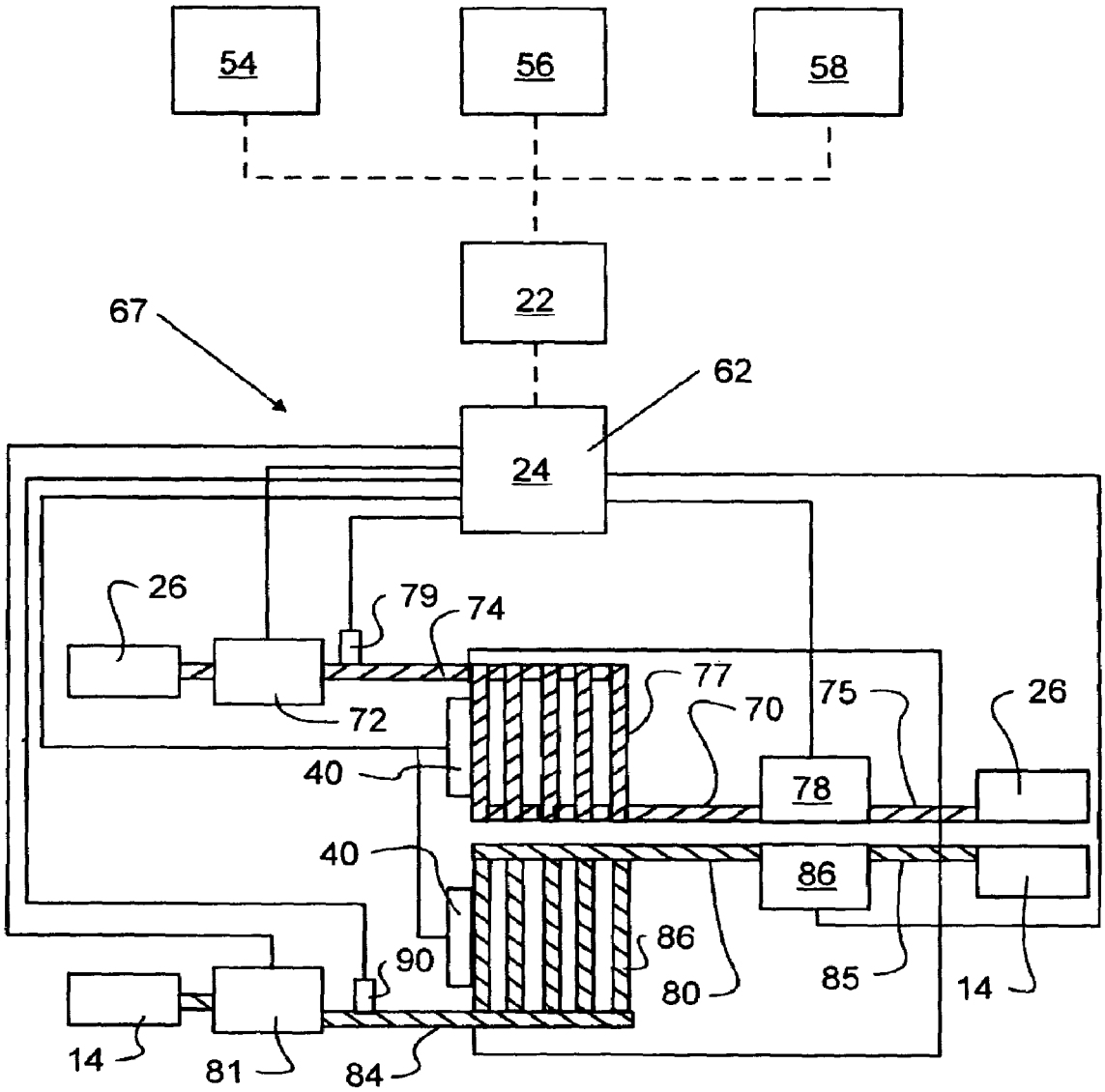
FIG. 11 is a block diagram of one embodiment of the invention with the primary cooling system removed.

Turning to the figures where like reference numerals refer to like structures, FIG. 1 shows a front portion of a motor vehicle 10, such as a truck 11, having an engine compartment 12 that houses an engine 14. The engine is coupled through a drivetrain to drive wheels (not shown) for moving the truck when driven. Engine 14 is shown by way of example as a diesel engine having its own liquid cooling system. Coolant circulates through coolant passages in the block and heads of engine 14 that form the engine combustion chambers. A primary pump 30 is typically used to circulate the coolant.

Some of the heat of combustion created in the engine combustion chambers radiates to the coolant circulating in a primary circuit 64 in the primary cooling system 13. The primary cooling system 13 has coolant circulating through a primary circuit 64 between a primary heat exchanger 16, such as radiator 27, and a heated motor vehicle apparatus 15, such as the engine 14 or the transmission 26. In this disclosure, the term "coolant" refers to any fluid used to cool a motor vehicle apparatus. Such fluids are typically water or water based for the engine and oil or transmission fluid for the transmission. Input 28 and output 29 tubing are in fluid communication with the primary heat exchanger 16 and connect the motor vehicle apparatus 15 with the primary heat exchanger 16. The primary pump 30 is in fluid communication with the primary heat exchanger 16 and helps circulate the coolant through the primary cooling system 13. Output tubing 29 connects with the primary pump 30. A frontally placed radiator 27 transfers heat from the circulating coolant by conductive transfer to ambient air flowing through the radiator 27. The frontal placement of radiator 27 takes advantage of ram air for forcing ambient air through the radiator 27 when the truck 11 is driven forward. Because ram air flow may at times be insufficient for adequate heat transfer, an engine cooling fan 31 associated with the radiator 27 draws ambient air through the radiator 27.

A proactive auxiliary cooling system 17 cools a heated motor vehicle apparatus 15, such as the engine 14 and/or transmission 26. The auxiliary cooling system 17 uses a secondary cooling system 18 connected to the primary cooling system 13 and a power source, such as power supply 24, connected to the secondary cooling system 18. A bypass circuit 66 diverts coolant from the primary cooling system 13 through bypass tubing 32 to a secondary heat exchanger 34, such as a radiator, a flow control valve, a heat exchange box 36, and the like. Heat radiates from the coolant in the bypass tubing 32 within an exchange bed 38 in the heat exchange box 36 to the air. A secondary fan 40 associated with an outer wall 42 of the heat exchange box 36 increases air flow around the exchange bed 38.

The cooled coolant returns from the secondary heat exchanger 34 through return tubing 33 to the primary cooling system 13 before circulating to the heated motor vehicle apparatus 15. A secondary pump 44, such as a mechanical or electrical pump, helps circulate the diverted coolant through the secondary cooling system 18 to the primary cooling system 13.

The bypass 66 and primary 64 circuits join at two junctions 46, 47. Some of the coolant is diverted from the primary cooling system 13 at the bypass junction 46. At the return junction 47, the coolant returns to the primary cooling system 13. An actuator 48 is used for at least one of the junctions. A T-fitting 52 or other appropriate fitting can be used at the other junction.

An actuator 48 such as a bypass valve 50 diverts the coolant from the primary cooling system 13 to the secondary cooling system 18. The bypass valve 50 can connect the bypass tubing 32 with the outlet tubing 29 at the bypass junction 46. The open bypass valve 50 diverts some of the coolant from the primary cooling system 13. An actuator 49, such as return valve 51, or a T-fitting 52 can be used at the return junction 47 connecting the return tubing 33 with the inlet tubing 29.

Alternatively, an actuator 49 such as a return valve 51 can be used at the return junction 47. When the return valve 51 is closed, coolant does not circulate in the secondary cooling system 18 and is not diverted into the bypass circuit. When the return valve 51 opens, some of the coolant flows into the secondary cooling system 18. A bypass valve 50 or a T-fitting 52 can be used at the bypass junction 46. The bypass 50 and return 51 valves are preferably solenoid valves connected to the power supply 24.

The motor vehicle 10 can have at least one information collecting module 20. The information collecting module 20 can have a processor for processing data relating to various motor vehicle operations and memory for storing data. The information collecting module 20 can also have a receiver for receiving data transmitted from outside of the motor vehicle, such as transmissions from a home base or satellite.

Examples of information collecting modules 20 include a global positioning system (GPS) module 54, a transmission module 56, an engine module 58, and the like. The GPS module 54 for example collects information related to geographic position of the motor vehicle, as well as elevation and grade of the road. The transmission module 56 collects information related to the oil temperature and pressure, transmission fluid and other conditions related to the transmission 26. The engine module 58 collects information related to condition in the engine 14, such as engine torque, manifold pressure, ambient temperature, intake air temperature, exhaust temperature, oil temperature and pressure and coolant temperature.

An electronic controller 22 cooperates with the information collecting module 20, generally communicating through a data bus. The electronic controller 22 can be programmed with set threshold points for data collected by the information collecting modules 20. The electronic controller 22, for example, can receive information relating to the oil temperature in the engine from the engine module 58. The electronic controller 22 can then increase the cooling of the engine 14 once the temperature of the oil increases beyond a specified threshold point.

The electronic controller 22 can be a computer or processor and may include memory for storing data. The electronic controller 22 can also be part of an electronic controller module 60 that includes a power supply 24 connected to the secondary cooling system, a receiver for receiving data transmitted from outside of the motor vehicle and any sensors, including sensors related to the secondary cooling system.

Alternatively, the power supply 24 is part of a power supply module 62 separate from the motor vehicle's electronic controller module 60. The power supply module 62 connects to and communicates with the electronic controller 22, preferably through a data bus. The power supply module 62 can also have a processor and memory for storing data. The power supply 24 connects to the secondary cooling system's actuator 48, temperature sensor 41, secondary fan 40 and secondary pump 44 to supply power to those devices.

A bypass circuit temperature sensor 41 is located downstream from the motor vehicle apparatus 15. The bypass circuit temperature sensor 41 measures the temperature of the coolant after leaving the motor vehicle apparatus 15 and transmits the information either directly to the electronic controller 22 or through the power supply module 62 which in turn signals the electronic controller 22.

The auxiliary cooling system 67 can have multiple bypass circuits 70, 80 in the secondary cooling system 68 as shown in FIGS. 8-11 to further control the cooling of the motor vehicle during use. The transmission bypass circuit 70, for example, has a transmission bypass valve 72 to divert some of the oil through the transmission bypass tubing 74 to the secondary heat exchanger 76 and to the transmission exchange bed 77. The cooled oil is pumped from the secondary heat exchanger 76 by the secondary transmission pump 78 through the return tubing 75 into the inlet tubing 28 at return junction 47. The transmission bypass circuit temperature sensor 79 measures the temperature of the oil in the transmission bypass circuit 70.

The engine bypass circuit 80 has a bypass junction 46 where some of the water based coolant diverts into the engine bypass tubing 84 through engine bypass valve 81. The coolant flows into the secondary heat exchanger 76 to dissipate heat in the exchange bed 86. Secondary engine pump 88 pumps the cooled coolant to the engine return tubing 85 at return junction 92 of the engine circuit 65. The engine bypass circuit temperature sensor 90 measures the temperature of the water based coolant in the transmission bypass circuit 80.

GPS module 54 has a GPS receiver for receiving satellite transmissions. The GPS module 54 or the electronic controller 22 can be programmed with data relating to road elevations, altitude, latitude, longitude, population density, motor vehicle density, and the like. The GPS module 54 or electronic controller 22 can also receive data from other sources, such as signals from the driver's home base to update the programmed data. Once the GPS module 54 calculates the location of the vehicle, the GPS module sends this information to the electronic controller 22.

The electronic controller 22 can be programmed to activate and deactivate the auxiliary cooling system 17 when reaching previously programmed threshold points determined by the type or types of information collecting modules used. These threshold points can include altitude, oil and coolant temperatures, oil pressure, engine torque, speed of the vehicle, intake and exhaust temperatures, and the like. For example, the electronic controller can have a particular altitude or change in altitude programmed as a threshold point.

Likewise, a particular location or area surrounding the location can be programmed as a threshold point. The GPS module 54, for example, can send data to the electronic controller 22 relating to the location of the motor vehicle. After receiving this data, the electronic controller 22 can compare the current location with the vehicle's previous location. When the location corresponds to the programmed threshold point, the electronic controller 22 activates the auxiliary cooling system 17 by communicating with the power supply module 62 and turning on the power supply 24. The power supply 24 in turn activates the secondary cooling system 18 and the bypass valve 50. The activated bypass valve 50 opens and diverts coolant from the inlet tubing 28 in the primary cooling system 13 into the bypass tubing 32 of the secondary cooling system 18. The secondary fan 40 and secondary pump 44 are turned on, and coolant flows through the bypass circuit 66.

When the motor vehicle leaves the area surrounding the threshold point or location, the electronic controller 22 can signal the power supply module 62 to turn off the secondary cooling system 18. The bypass valve 50 closes, and the secondary fan 40 and secondary pump 44 turn off. If the temperature measured by the bypass circuit temperature sensor 41 is greater than the threshold point for the secondary cooling system, the deactivation of the secondary cooling system 18 can be delayed until the bypass circuit temperature sensor measures the lower temperature.

Similarly, the grade of road can be measured by the change of altitude measured by the GPS module 54. When the change of altitude reaches the threshold point, the auxiliary cooling system is activated by the electronic controller. When the change of altitude crosses the threshold point again, the electronic controller deactivates the auxiliary cooling system.

The transmission module 56 can measure the oil temperature and pressure in the transmission. When the oil temperature reaches a threshold oil temperature and/or pressure set as the threshold point, the electronic controller activates the auxiliary cooling system. The auxiliary cooling system remains on to cool the transmission secondary cooling system until the oil temperature drops below the threshold oil temperature, and the secondary transmission sensor drops below a secondary transmission coolant threshold temperature. Once below these threshold points, the electronic controller deactivates the auxiliary cooling system.

The engine module 56 can measure the oil temperature and pressure in the engine. When the oil temperature reaches a threshold oil temperature and/or pressure set as the threshold point(s), the electronic controller activates the auxiliary cooling system. The auxiliary cooling system remains on to cool the engine secondary cooling system until the oil temperature and/or pressure drop below the threshold oil temperature and/or pressure and the temperature measured by the bypass circuit temperature sensor drops below the secondary coolant threshold temperature. Once below these threshold points, the electronic controller deactivates the auxiliary cooling system.

Alternatively, the driver can manually turn on and off the auxiliary cooling system from a switch on the instrument panel of the motor vehicle. By turning on the switch, the power supply module 62 can be activated and in turn activate the secondary cooling system.

Multiple information collecting modules can be used in the motor vehicle, with the information communicated to the electronic controller. GPS module 54 for example can collect information related to the geographic location of the motor vehicle. Engine module 58 can collect information related to the engine torque, ambient temperature, and the like. If the GPS module 54 reaches a threshold point relating to a normally hot desert location, for example, the electronic controller can activate the auxiliary cooling system before the engine requires cooling. Data communicated by the engine module 58 to the electronic controller, however, can delay the activation of the auxiliary cooling system if the ambient temperature is below its threshold point related to the geographic location and the oil temperature is below its threshold point related to the geographic location. Similarly if the data communicated by the transmission module and the engine module to the electronic controller show the motor vehicle has reached one or more threshold points, the electronic controller can activate the auxiliary cooling system, even though the GPS module has not reached its threshold point.

Therefore, when the auxiliary cooling system is activated can depend on the information related to the motor vehicle conditions collected by the multiple information collecting modules. Because multiple threshold points can occur, the electronic controller can be programmed to coordinate these different threshold points and to activate the auxiliary cooling system at the best time for cooling. Furthermore, if multiple secondary cooling systems are used, such as for the transmission and engine, each secondary cooling system can be activated or remain activated independent of the other.

The auxiliary cooling system of the invention has a number of advantages. Using the auxiliary cooling system allows the motor vehicle to use a smaller size primary cooling system to handle cooling for average road and driving conditions. The cooling capacity of the auxiliary cooling system augments the primary cooling system for extreme conditions. The auxiliary cooling system could be activated manually by the driver or through the use of an electronic controller.

Another advantage to the proactive auxiliary cooling system of the invention is the quick responsiveness of the system. The auxiliary cooling system could turn on and start cooling the motor vehicle apparatus before reaching extreme operating conditions, such as at different geographic locations.

A further advantage to the proactive auxiliary cooling system of the invention is that system could be selectively installed during assembly. The owner of the motor vehicle only needs to buy and have installed the modules related to conditions motor vehicle is likely to encounter.

While the invention is shown in only one of its forms, it is not thus limited but is susceptible to various changes and modifications without departing from the spirit and scope of the invention.

What is claimed is:

1. A proactive cooling system for cooling a motor vehicle apparatus in a motor vehicle, comprising:

a primary cooling system having a primary heat exchanger, input and output tubing connecting the primary heat exchanger to the motor vehicle apparatus, and a primary pump in fluid communication with the primary heat exchanger;

a secondary cooling system comprising: a bypass circuit in fluid communication with the input and output tubing of the primary cooling system, a secondary heat exchanger to remove heat from the bypass circuit and a secondary pump being in fluid communication with the bypass circuit;

an actuator connecting the secondary cooling system with the primary cooling system;

a power supply for activating the secondary pump and the actuator;

an electronic controller being programmed to activate the power supply after reaching a threshold point; and an information collecting module for collecting information relating to the motor vehicle during operation and for communicating with the electronic controller data relating to the threshold point.

2. A proactive cooling system for cooling a motor vehicle apparatus in a motor vehicle of claim 1, wherein the secondary cooling system further comprises:

a secondary fan being associated with the secondary heat exchanger and being activated by the power supply.

3. A proactive cooling system for cooling a motor vehicle apparatus in a motor vehicle of claim 2, further comprising:

a bypass circuit temperature sensor for measuring coolant temperature in the bypass circuit.

4. A proactive cooling system for cooling a motor vehicle apparatus in a motor vehicle of claim 3, further comprising:

a power supply module containing the power supply and for communicating with the electronic controller and the secondary sensor.

5. A proactive cooling system for cooling a motor vehicle apparatus in a motor vehicle of claim 4, wherein the information collecting module is a transmission module, and the primary and secondary cooling systems are transmission cooling systems.

6. A proactive cooling system for cooling a motor vehicle apparatus in a motor vehicle of claim 4, wherein the information collecting module is an engine module, and the primary and secondary cooling systems are engine cooling systems.

7. A proactive cooling system for cooling a motor vehicle apparatus in a motor vehicle, comprising:

a primary cooling system having a primary heat exchanger, input and output tubing connecting the primary heat exchanger to the motor vehicle apparatus, and a primary pump being in fluid communication with the primary heat exchanger;

a secondary cooling system comprising a bypass circuit in fluid communication with the input and output tubing of the primary cooling system, a secondary heat exchanger to remove heat from the bypass circuit, and a secondary pump being in fluid communicating with the bypass circuit;

an actuator connecting the secondary cooling system with the primary cooling system;

a power supply for activating the secondary pump and the actuator, an electronic controller being programmed to activate the power supply after reaching a threshold point; and a GPS module for collecting geographic information relating to the location of the motor vehicle during operation and for communicating with the electronic controller data relating to the threshold point.

8. A proactive cooling system for cooling a motor vehicle apparatus in a motor vehicle of claim 7, wherein the secondary cooling system further comprises:

a secondary fan being associated with the secondary heat exchanger and being activated by the power supply.

9. A proactive cooling system for cooling a motor vehicle apparatus in a motor vehicle of claim 8, further comprising:

a bypass circuit temperature sensor for measuring coolant temperature in the bypass circuit.

10. A proactive cooling system for cooling a motor vehicle apparatus in a motor vehicle of claim 9, further comprising:

a power supply module containing the power supply and for communicating with the electronic controller and the secondary sensor.

11. A proactive cooling system for cooling a motor vehicle apparatus in a motor vehicle of claim 10, further comprising:

an information collecting module for collecting information relating to the motor vehicle during operation and for communicating with the electronic controller data relating to the threshold point.

12. A proactive cooling system for cooling a motor vehicle apparatus in a motor vehicle of claim 11, wherein the information collecting module is a transmission module, and the primary and secondary cooling systems are transmission cooling systems.

13. A proactive cooling system for cooling a motor vehicle apparatus in a motor vehicle of claim 12, wherein the information collecting module is an engine module, and the primary and secondary cooling systems are engine cooling systems.

14. A proactive cooling system for cooling a motor vehicle apparatus in a motor vehicle of claim 10, further comprising:

information collecting modules for collecting information relating to the motor vehicle during operation and for communicating with the electronic controller data relating to the threshold point.

15. A proactive cooling system for cooling an engine and a transmission in a motor vehicle, comprising:

a primary heat exchanger;

an engine primary cooling system having engine input and output tubing connecting the primary heat exchanger to the engine, and a primary engine pump in fluid communication with the primary heat exchanger;

a transmission primary cooling system having transmission input and output tubing connecting the primary heat exchanger to the transmission, and a primary transmission pump in fluid communication with the primary heat exchanger;

a secondary cooling system comprising an engine bypass circuit in fluid communication with the engine input and output tubing of the engine primary cooling system, a transmission bypass circuit in fluid communication with the transmission input and output tubing of the transmission primary cooling system, a secondary heat exchanger to remove heat from the engine and transmission bypass circuits, a secondary engine pump being in fluid communication with the engine bypass circuit, and a secondary transmission pump being in fluid communication with the transmission bypass circuit;

an engine actuator connecting the engine bypass circuit with the engine primary cooling system;

a transmission actuator connecting the transmission bypass circuit with the transmission primary cooling system;

a power supply for activating the secondary engine and transmission pumps and the actuator; and means for activating the power supply.

16. A proactive cooling system for cooling an engine and a transmission in a motor vehicle of claim 15, wherein the secondary cooling system further comprises:

a secondary fan being associated with the secondary heat exchanger and being activated by the power supply.

17. A proactive cooling system for cooling an engine and a transmission in a motor vehicle of claim 16, further comprising:

an engine bypass circuit temperature sensor for measuring engine coolant temperature in the engine bypass circuit; and a transmission bypass circuit temperature sensor for measuring coolant temperature in the transmission bypass circuit.

18. A proactive cooling system for cooling an engine and a transmission in a motor vehicle of claim 17, wherein the means for activating the power supply comprises:

an electronic controller being programmed with at least one threshold point and to activate the power supply after reaching the threshold point;

an engine module for collecting information relating to the motor vehicle during operation and for communicating with the electronic controller data relating to the threshold point; and a transmission module for collecting information relating to the motor vehicle during operation and for communicating with the electronic controller data relating to the threshold point.

19. A proactive cooling system for cooling an engine and a transmission in a motor vehicle of claim 18, further comprising:

a power supply module containing the power supply and for communicating with the electronic controller and the secondary sensor.

20. A proactive cooling system for cooling an engine and a transmission in a motor vehicle of claim 19, further comprising:

a GPS module for collecting geographic information relating to the location of the motor vehicle during operation and for communicating with the electronic controller data relating to the threshold point.

21. A proactive cooling system for cooling an engine and a transmission in a motor vehicle of claim 17, wherein the means for activating the power supply comprises:

an electronic controller being programmed to activate the power supply after reaching a threshold point; and a GPS module for collecting geographic information relating to the location of the motor vehicle during operation and for communicating with the electronic controller data relating to the threshold point.

22. A method for cooling a motor vehicle apparatus located within a motor vehicle, the method comprising the steps of:

(a) circulating coolant in a primary cooling system having a primary heat exchanger, input and output tubing connecting the primary heat exchanger to the motor vehicle apparatus, and a primary pump being in fluid communication with the primary heat exchanger;

(b) collecting information related to the motor vehicle with an information collecting module;

(c) transmitting data between the information collecting module and an electronic controller;

(d) comparing data relating to the collected information with a threshold point;

(e) activating a power supply after reaching the threshold point;

(f) supplying power from the activated power supply to a secondary cooling system;

(g) opening a bypass circuit in the secondary cooling system after reaching the threshold point;

(h) diverting coolant from the primary cooling system into the opened bypass circuit;

(i) circulating diverted coolant in the bypass circuit;

(j) measuring coolant temperature in the bypass circuit with a bypass circuit temperature sensor;

(k) communicating bypass circuit temperature data to the electronic controller (l) cooling the diverted coolant in a secondary heat exchanger in the secondary cooling system;

(m) pumping the diverted coolant from the secondary heat exchanger with a secondary pump in the secondary cooling system: and (n) returning the cooled coolant from the bypass circuit to the primary cooling system through return tubing connecting to the secondary pump.

23. A method for cooling a motor vehicle apparatus within a motor vehicle of claim 22, the method further comprising the steps of:

(o) returning below the threshold point (p) closing the bypass circuit to prevent coolant from diverting from the primary cooling system to the secondary cooling system after returning below the threshold point; and (q) deactivating the power supply.

24. A method for cooling a motor vehicle apparatus within a motor vehicle of claim 22, wherein the electronic controller is programmed with the threshold point and activates the power supply.

25. A method for cooling a motor vehicle apparatus within a motor vehicle of claim 24, the method further comprising the steps of:

(o) collecting additional information with a second information collecting module;

(p) transmitting data between the second information collecting module and the electronic controller;

(q) comparing the collected additional information with an additional threshold point; and wherein the power supply is activated and the bypass circuit in the secondary cooling system is opened after reaching one of the threshold points.

26. A method for cooling a motor vehicle apparatus within a motor vehicle of claim 25 wherein the primary cooling system is a transmission primary cooling system, and the bypass circuit is a transmission bypass circuit.

27. A method for cooling a motor vehicle apparatus within a motor vehicle of claim 25, wherein the primary cooling system is an engine primary cooling system, connecting to an engine, and the bypass circuit is an engine bypass circuit.

28. A method for cooling a motor vehicle apparatus within a motor vehicle of claim 22, the method further comprising the steps of:

(o) circulating transmission coolant in a transmission primary cooling system having transmission input and output tubing connecting the primary heat exchanger to a transmission;

(p) opening a transmission bypass circuit in the secondary cooling system after reaching the threshold point;

(q) diverting transmission coolant from the transmission primary cooling system into the opened transmission bypass circuit;

(r) circulating diverted transmission coolant in the transmission bypass circuit (s) measuring transmission coolant temperature in the transmission bypass circuit with a transmission bypass circuit temperature sensor;

(t) communicating transmission bypass circuit temperature data to the electronic controller;

(u) pumping the diverted transmission coolant with a secondary transmission pump in the secondary cooling system; and (v) returning the cooled transmission coolant from the transmission bypass circuit to the transmission primary cooling system through transmission return tubing connecting to the secondary transmission pump; and wherein the primary cooling system is an engine primary cooling system connecting to an engine, and the bypass circuit is an engine bypass circuit

29. A method for cooling a motor vehicle apparatus within a motor vehicle of claim 28, the method further comprising the steps of:

(w) collecting additional information with a second information collecting module;

(x) transmitting data between the second information collecting module and the electronic controller;

(y) comparing the collected additional information with an additional threshold point; and (z) wherein the power supply is activated and the bypass circuits in the secondary cooling system are opened after reaching one of the threshold points.

30. A method for cooling a motor vehicle apparatus within a motor vehicle of claim 29, wherein the information collecting module is a GPS module, and the threshold point is related to the data collected by the GPS module.

31. A method for cooling an engine and a transmission located within a motor vehicle, the method comprising the steps of:

(a) circulating engine coolant in an engine primary cooling system having engine input and output tubing connecting a primary heat exchanger to the engine with a primary engine pump in fluid communication with the primary heat exchanger;

(b) circulating transmission coolant with a primary transmission pump in a transmission primary cooling system having transmission input and output tubing connecting the primary heat exchanger to a transmission;

(c) activating a power supply;

(d) supplying power from the activated power supply to a secondary cooling system having an engine bypass circuit connecting with the engine primary cooling system, and a transmission bypass circuit connecting with the transmission primary cooling system;

(e) opening the engine bypass circuit in the secondary cooling system;

(f) diverting engine coolant from the engine primary cooling system into the opened bypass circuit and into a secondary heat exchanger for cooling;

(g) opening a transmission bypass circuit in the secondary cooling system;

(h) diverting transmission coolant from the transmission primary cooling system into the opened transmission bypass circuit and into the secondary heat exchanger for cooling;

(i) measuring engine coolant temperature in the engine bypass circuit with an engine bypass circuit temperature sensor (j) measuring transmission coolant temperatures in the transmission bypass circuit with a bypass circuit temperature sensor;

(k) pumping the diverted engine coolant with a secondary engine pump in fluid communication with the engine bypass circuit in the secondary cooling system and returning the cooled engine coolant from the engine bypass circuit to the engine primary cooling system; and (l) pumping the diverted transmission coolant with a secondary transmission pump in fluid communication with the transmission bypass circuit in the secondary cooling system and returning the cooled transmission coolant from the transmission bypass circuit to the transmission primary cooling system.

32. A method for cooling a motor vehicle apparatus within a motor vehicle of claim 31, the method further comprising the steps of:

(m) returning below the threshold point;

(n) closing the bypass circuits to prevent fluid from diverting from the primary cooling systems to the secondary cooling system after returning below the threshold point; and (o) deactivating the power supply.

33. A method for cooling an engine and a transmission located within a motor vehicle, of claim 31, the method further comprising the steps of:

(m) collecting information related to the motor vehicle with an information collecting module;

(n) transmitting data between the information collecting module and an electronic controller;

(o) comparing data relating to the collected information with a threshold point programmed in the electronic controller;

(p) communicating bypass circuit temperature data to the electronic controller; and wherein the electronic controller activates the power supply after reaching the threshold point.

34. A method for cooling a motor vehicle apparatus within a motor vehicle of claim 33, wherein the information collecting module is a GPS module, and the threshold point is related to the data transmitted by the GPS module.

35. A method for cooling a motor vehicle apparatus within a motor vehicle of claim 31, the method further comprising the steps of:

(m) collecting geographic information related to the motor vehicle with a GPS module;

(n) transmitting data between the GPS module and an electronic controller;

(o) comparing data relating to the collected geographic information with a first threshold point programmed in the electronic controller;

(p) communicating bypass circuit temperature data to the electronic controller:

(q) collecting additional information with a second information collecting module;

(r) transmitting data between the second information collecting module and the electronic controller, (s) comparing the collected additional information with a second threshold point programmed in the electronic controller; and wherein the power supply is activated after reaching one of the threshold points.

36. A method for cooling a motor vehicle apparatus within a motor vehicle of claim 35, the method further comprising the steps of:

(t) collecting additional information with a third information collecting module;

(u) transmitting data between the third information collecting module and the electronic controller; and (v) comparing the collected additional information collected with the third information collecting module with a third threshold point.

* * * * *